US006604617B2

(12) United States Patent
Davis et al.

(10) Patent No.: US 6,604,617 B2
(45) Date of Patent: Aug. 12, 2003

(54) WHEELED LIGHTWEIGHT COLLAPSIBLE LUGGAGE

(75) Inventors: Robert P. Davis, Vidalia, GA (US); Jeffrey A. Bertelsen, Somerville, NJ (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 09/801,374

(22) Filed: Mar. 7, 2001

(65) Prior Publication Data

US 2002/0125089 A1 Sep. 12, 2002

(51) Int. Cl.[7] ..... A45C 7/00
(52) U.S. Cl. ..... 190/107; 280/37
(58) Field of Search ..... 190/103, 107, 190/122, 123, 127, 18 A, 18 R, 24, 115; 280/37, 655

(56) References Cited

U.S. PATENT DOCUMENTS

| | | | | |
|---|---|---|---|---|
| 672,143 | A | 4/1901 | Boughner | |
| 1,513,909 | A | 11/1924 | Hunter | |
| 2,405,361 | A | 8/1946 | Langford et al. | |
| 2,496,128 | A | 1/1950 | Lifton | |
| 2,710,084 | A | 6/1955 | Braverman | 190/43 |
| 2,716,473 | A | 8/1955 | Droutman | 190/49 |
| 2,718,943 | A | 9/1955 | Braverman | 190/41 |
| 3,443,671 | A | 5/1969 | Dyke | 190/43 |
| 3,447,648 | A | 6/1969 | Schwennicke | 190/44 |
| 3,504,772 | A | 4/1970 | Barry | 190/45 |
| 4,160,496 | A | 7/1979 | Knight | 190/43 |
| 4,588,056 | A | 5/1986 | Bernbaum | 190/107 |
| 4,953,673 | A | 9/1990 | Ambasz | 190/103 |
| 5,103,945 | A | 4/1992 | Kaneko | 190/107 |
| 5,197,580 | A | 3/1993 | Berman et al. | 190/107 |
| 5,251,731 | A | 10/1993 | Cassese et al. | 190/107 |
| D352,395 | S | 11/1994 | King | D3/279 |
| 5,456,342 | A | 10/1995 | Rekuc et al. | 190/18 |
| 5,482,147 | A * | 1/1996 | Wang | 190/115 |
| D370,997 | S * | 6/1996 | Hsieh | D3/318 |
| D374,773 | S | 10/1996 | Domotor | D3/279 |
| D375,402 | S | 11/1996 | Yeh | D3/217 |
| 5,671,831 | A | 9/1997 | Chiu | 190/103 |
| 5,676,286 | A | 10/1997 | Song | 224/153 |
| 5,685,401 | A | 11/1997 | Macgillivray et al. | 190/108 |
| D387,198 | S | 12/1997 | Lehmann et al. | D3/217 |
| 5,743,363 | A | 4/1998 | Rekuc et al. | 190/18 |
| 5,743,447 | A | 4/1998 | McDermott | 224/153 |
| 5,749,446 | A * | 5/1998 | Hsieh | 190/103 |
| 5,819,891 | A | 10/1998 | Wang et al. | 190/103 |
| 5,833,039 | A | 11/1998 | Kotkins, Jr. | 190/115 |
| 5,927,451 | A | 7/1999 | Tsai | 190/115 |
| 6,021,874 | A | 2/2000 | Nykoluk | 190/103 |
| 6,059,078 | A | 5/2000 | Nykoluk | 190/103 |
| 6,062,357 | A | 5/2000 | Bogert | 190/18 |
| 6,109,403 | A | 8/2000 | Godshaw | 190/18 |
| 6,148,973 | A * | 11/2000 | Chang | 175/428 |
| 6,227,339 | B1 * | 5/2001 | Bogert | 190/107 |

* cited by examiner

*Primary Examiner*—Lee Young
*Assistant Examiner*—Lien Ngo
(74) *Attorney, Agent, or Firm*—Baker Botts LLP

(57) ABSTRACT

A luggage item has a frame that includes a top pan and a bottom pan that are joined by towing bar-receiving tubes. A body of flexible material is fitted to the frame. The frame and body are free of elements along the top wall, bottom wall and the side walls that inhibit folding of the top wall, bottom wall and the side walls along fold lines intermediate the front wall and back wall so that the front part of the bag can be collapsed toward the back wall to substantially reduce the volume of the bag.

20 Claims, 7 Drawing Sheets

WHEELED LIGHTWEIGHT COLLAPSIBLE LUGGAGE

BACKGROUND OF THE INVENTION

The present invention relates to wheeled luggage and, in particular, to wheeled luggage that is light in weight and can be partially collapsed for easier storage.

Generally, wheeled luggage is constructed with a frame and wall system that makes it into a box having five rigid sides. The frame and wall system is enclosed by a body of a flexible material, usually a fabric. The sixth side has a panel that is usually flexible and is zippered along three edges to provide access to the box. The frame usually has top and bottom pans—so-named for their "pan shape" with a base and edge flanges—that are molded from a rigid durable plastic and are coextensive with the top and bottom walls. Parallel tubes that receive the legs of a U-shaped towing bar join the top and bottom pans. The bottom pan supports wheels. Side stiffener panels, which are coextensive with the sides of the body, and a back panel are joined to the flange portions of the top and bottom pans.

Like most "old-fashioned" hand-carried luggage, modern wheeled luggage of the type described above is strong and durable and serves its purpose very well. It has the additional advantage of being easy to move by towing it on its wheels. Full-framed luggage, either with or without wheels, has the disadvantages of being relatively heavy, in large part because of the frame and stiffener panel system, and of occupying a large amount of space when stored.

BRIEF SUMMARY OF THE INVENTION

An object of the present invention is to provide wheeled luggage that is light in weight and is partially collapsible. Another object is to provide wheeled luggage that is easy to assemble.

Throughout the present specification, the terms "top," "bottom," "back," front," and "sides" are used for convenience with reference to the item of wheeled luggage standing upright with the wheels resting on the floor and the zippered panel of the body oriented vertically and facing the observer.

The objects referred to above are attained, in accordance with the present invention, by luggage that includes a frame having a top pan, a bottom pan, and a pair of spaced-apart parallel towing bar-receiving tubes joining the top pan to the bottom pan in spaced-apart relation and a body of flexible material fitted to the frame and having a top wall, a bottom wall, side walls, a front wall and a back wall, the walls being interconnected to form an enclosure to receive articles. The top pan and the bottom pan have front edges that are spaced apart from the front wall of the body. The frame and body are free of elements along the top wall, bottom wall and the side walls that inhibit folding of the top wall, bottom wall and the side walls along fold lines intermediate the front wall and back wall so that front portions of the top wall, bottom wall and the side walls are foldable toward the back wall to enable the front wall to be collapsed toward the back wall to substantially reduce the volume of the enclosure formed by the body.

The luggage, as described above, is significantly lighter in weight than previously known luggage, taking into account the size, inasmuch as the top and bottom pans of luggage according to the invention extend only part way from the back toward the front, the front edges being spaced apart from the front wall, and at least parts of the conventional side wall stiffening panels are not present so that the front part of the body can collapse toward the back. The frame and stiffener panel system of a bag according to the invention also lacks many fasteners that are present in previously known luggage to join the frame and panels.

The ability to collapse the body considerably reduces the volume needed to store the luggage and makes it possible to store it conveniently in places that are usually not suitable, such as under beds, on closet shelves and even in bureau drawers.

In preferred embodiments, the top pan has a top web portion engaged by a rear portion of the top wall of the body and having a front edge that is spaced apart from a juncture of the top wall with the front wall of the body and is coextensive laterally with the top wall of the body. The top wall of the body is joined to the top pan by a flap on the top wall that extends at least partway along the front edge of the top pan, is received under the top portion of the top pan, and is secured to the top portion of the top pan by a releasable fastener, such as a strip of hook and loop fastener. The bottom pan has a bottom portion engaged by a rear portion of the bottom wall of the body and having a front edge that is spaced apart from a juncture of the bottom wall with the front wall of the body and is coextensive laterally with the bottom wall of the body. The body is joined to the bottom pan by a flap on the bottom wall that extends at least partway along the front edge of the bottom pan, is received on top of the bottom portion of the bottom pan, and is secured to the upper side of the bottom portion of the bottom pan by a releasable fastener, such as a strip of hook and loop fastener. The flaps on the top and bottom walls that secure them to the pans permit the body to be fitted to the frame and held in proper position while subsequent assembly steps are carried out and also aid in keeping the body properly and securely fitted to the frame even after various fasteners and panels that hold the body on the frame are installed.

The fold lines along which the side, top and bottom walls fold, preferably, lie substantially in a plane that is parallel to the bar-receiving tubes of the frame. The plane of the fold lines may be a plane defined by the front edges of the top and bottom pans. With that structure, the body collapses uniformly from front to back. The plane of the fold lines may be about midway between the front wall and rear wall of the body.

As an optional but desirable feature, the luggage may include a side stiffener panel substantially coextensive with a rear portion of each of the side walls of the body rearwardly of the fold line. Also, a rear stiffener panel substantially coextensive with the rear wall of the body may be provided inside the back wall of the body.

In order to facilitate packing the luggage, a foldable stiffening panel joined to the frame for pivotal movement between a folded-up position and a position in which a front edge of the foldable stiffening panel is detachably secured to a front portion of the bottom wall of the body can be provided to hold the bottom wall of the body extended to make access to the interior easier. The foldable stiffening panel also provides additional stability to the bottom of the luggage item so that it can rest upright on the bottom.

To advantage, each of the bar-receiving tubes may be secured by a fastener to the bottom pan and joined to the top pan by reception in sockets associated with the top pan without any fasteners. The top pan is held in place with the tubes seated in the sockets by tension in the body of the luggage. The elimination of fasteners at the tops of the tubes, except for the screws that attach the bezel to the top pan, facilitates assembly and saves a little weight.

For a better understanding of the invention and the advantages it provides, reference may be made to the following description of an exemplary embodiment, taken in conjunction with the accompanying drawings.

DESCRIPTION OF THE EMBODIMENT

Figure 1:
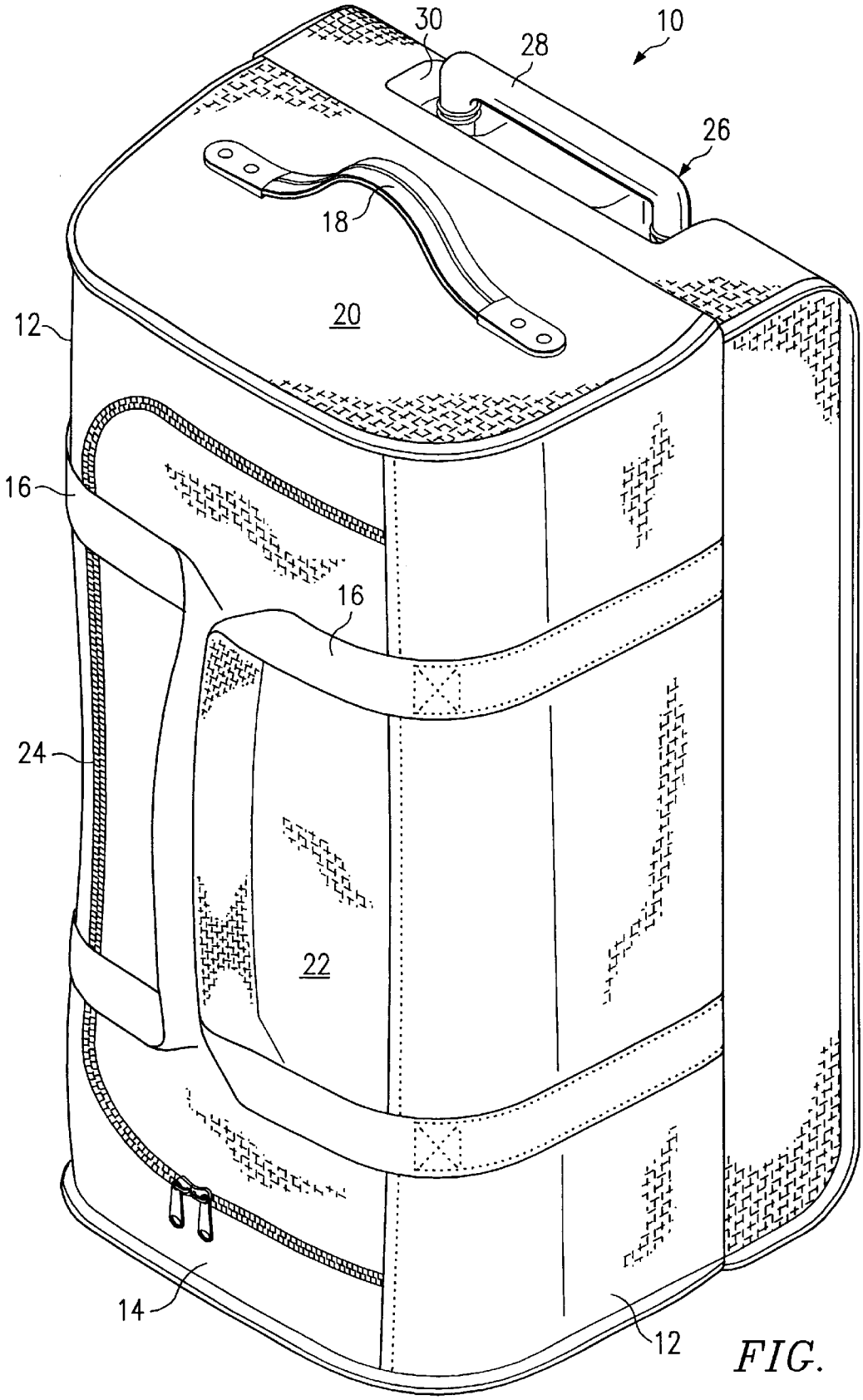
FIG. 1 is a three-quarter front perspective view, taken from a viewpoint above and to the right side of the embodiment.
Figure 2:
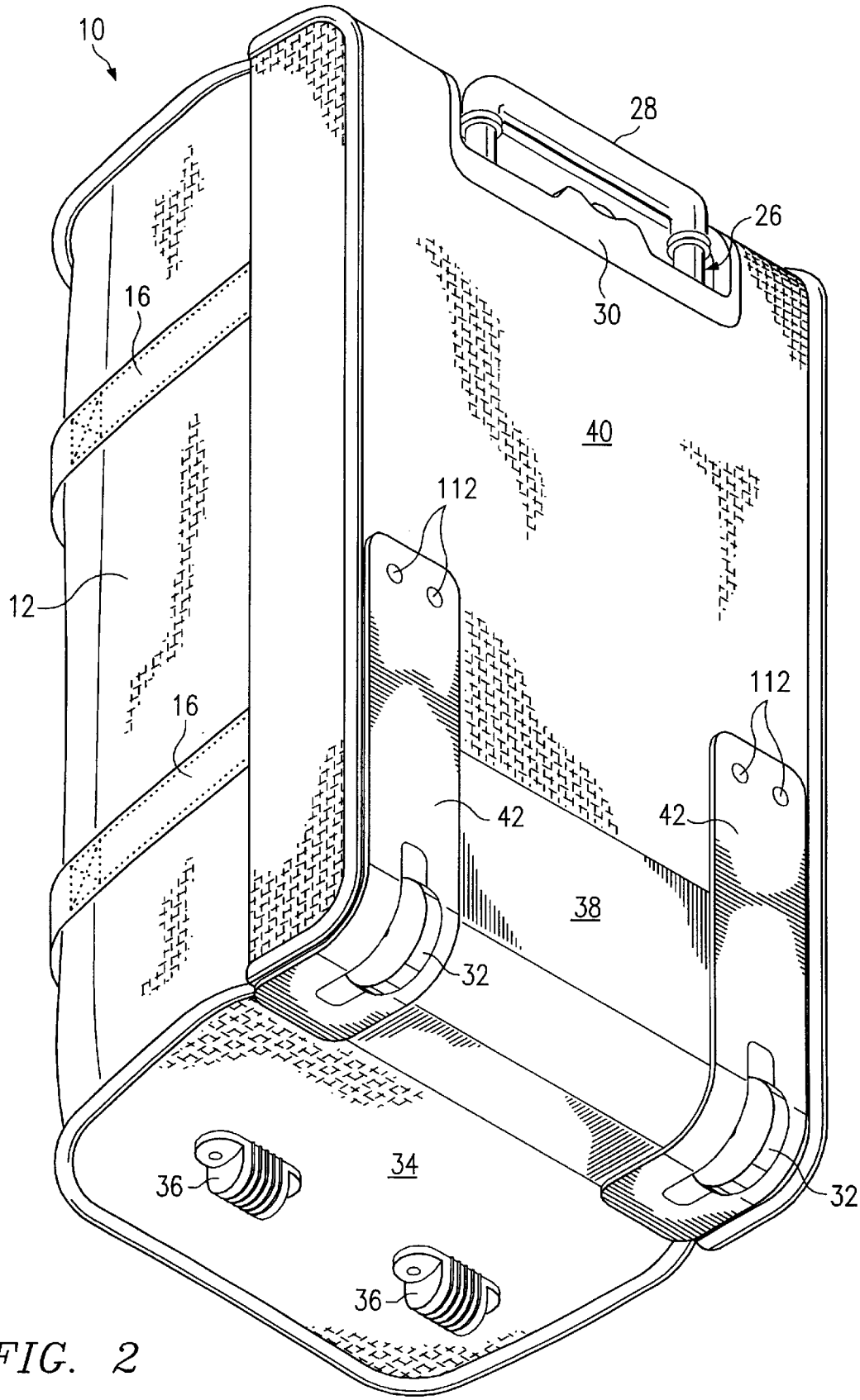
FIG. 2 is a three-quarter rear perspective view, taken from a viewpoint below and to the right side of the embodiment.

Referring to FIGS. 1 and 2, the embodiment 10 is an item of wheeled luggage that has a body of a flexible material, such as a durable fabric, which is shaped and fitted out to be of a duffel bag style. It has side walls 12 that curve toward each other adjacent the front wall 14. A pair of webbing loops 16 stitched to the side walls permit the bag to be carried with the front wall 14 uppermost. A carrying strap 18 on the top wall 20 allows the user to lift and carry The bag with the top wall uppermost. A flap 22 in the front wall has a zipper 24 along three sides, which when undone allows the flap to be folded back for access to the interior of the bag.

A U-shaped towing bar 26 is received telescopically in tubes (described below) received within the body. The handgrip 28 of the towing bar is recessed into a bezel 30 located at the rear of the top wall. Wheels 32 located near each rear corner of the bottom wall 34 of the bag allow a user to roll the bag along a floor or other surface. The bag can rest upright on the wheels 32 and on feet 36 affixed to a stiffener strip (not shown) near the front edge of the bottom wall. A protective panel 38 of a durable material, such as a semi-rigid plastic sheet, extends along the rear portion of the bottom wall 34 and the lower portion of the back wall 40. Skid rails 42 along the lower portions of each side of the back wall allow the bag to be dragged over curbs and stairs and also add stiffness to the lower rear portion of the bag.

Figure 3:
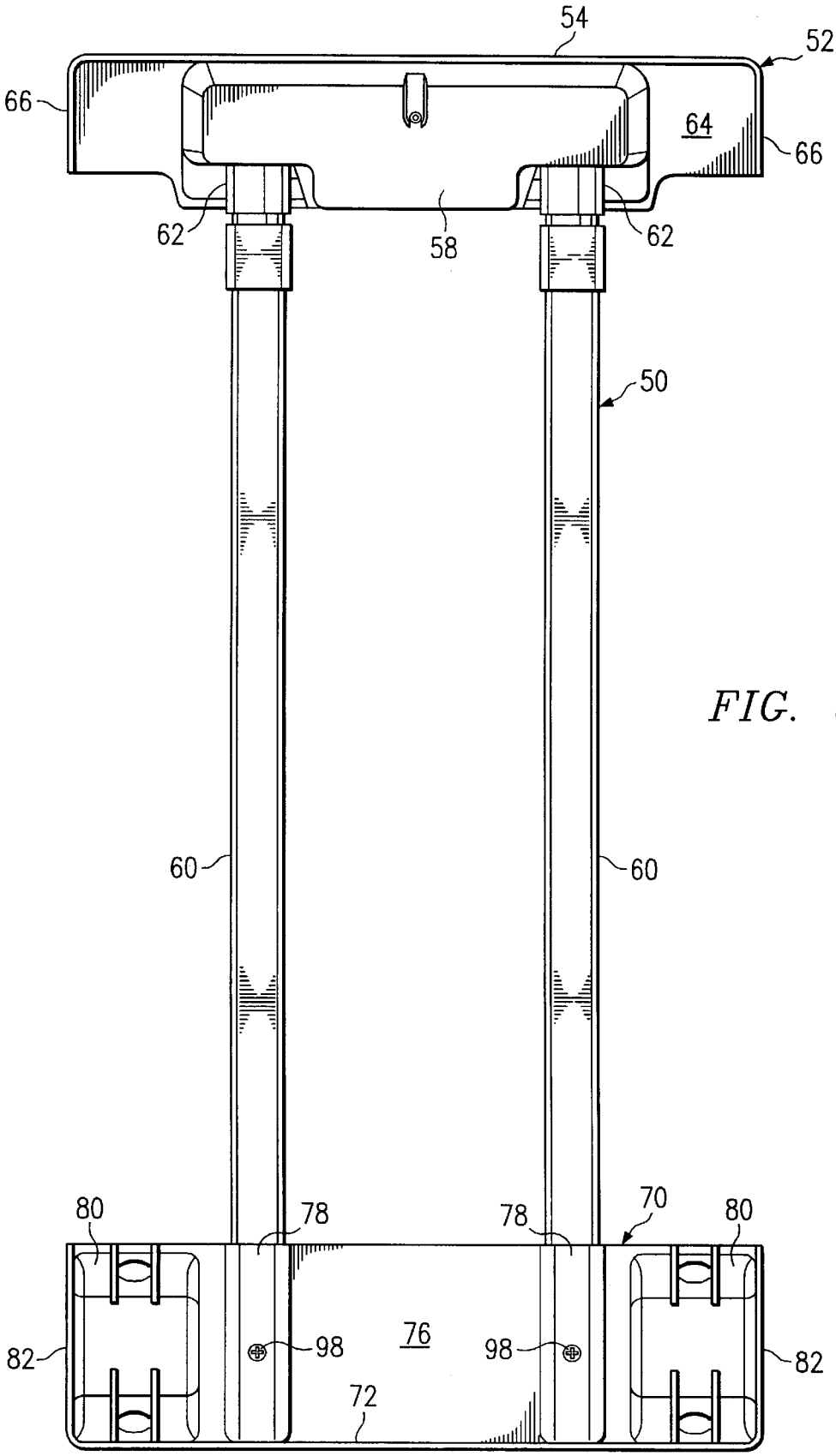
FIG. 3 is a front elevational view of the frame of the embodiment.
Figure 4:
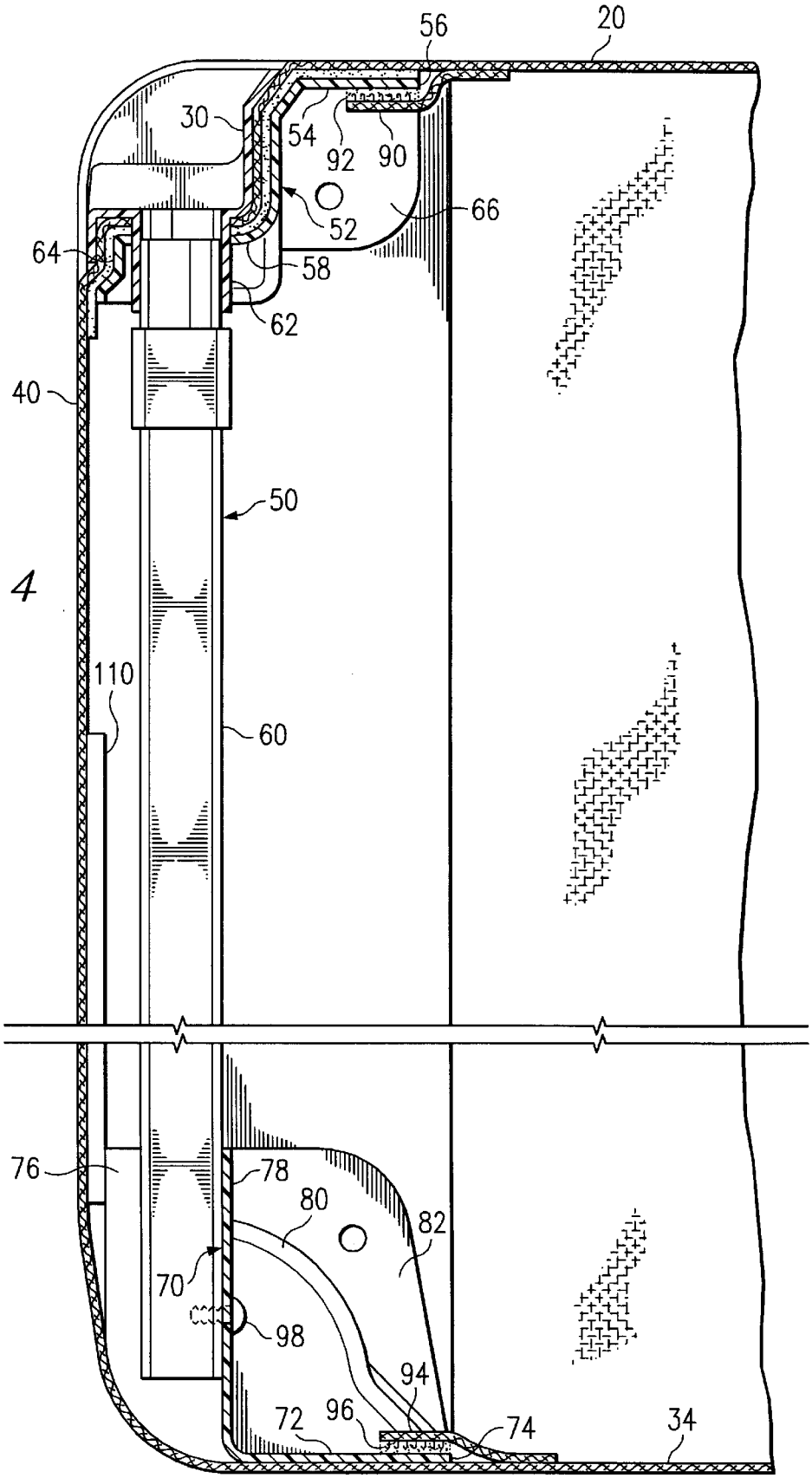
FIG. 4 is a partial side cross-sectional view of the rear portion of the embodiment, the section being taken generally along a vertical plane centered on the axis of the left bar-receiving tube and looking from left to right.

A lightweight frame 50 is received within the rear portion of the flexible outer body (see FIGS. 3 and 4). A top pan 52 of generally L-shape in side cross-section has a top web portion 54 that is engaged by the rear portion of the top wall 20 of the body and has a front edge 56 that is spaced apart from the juncture of the top wall with the front wall of the body and is coextensive laterally with the top wall of the body. A recessed portion 58 along the center region of the top pan 52 accepts the bezel 30 in nested relation. The bezel, which incorporates a latch (not shown) for the towing bar 26, is affixed to the top pan by screws (not shown).

The upper ends of towing bar-receiving tubes 60 are received telescopically in dependent socket portions 62 of the bezel 30, the socket portions 62 passing through holes in the top pan. A rear web portion 64 (FIG. 4) of the top pan 52 extends laterally along the entire width of the upper portion of the back wall 40 of the body. A side flange 66 at each end of the top pan 52 joins the top web portion 54 to the rear web portion 64 and shapes and stiffens the pan and the upper rear corner portions of the outer body of the bag.

A bottom pan 70 of the frame has a bottom web portion 72 that engages and shapes the rear portion of the bottom wall 34 and the lower portion of the back wall 40 of the body. The front edge 74 of the bottom web portion 72 is spaced apart from the juncture of the bottom wall with the front wall of the body and is coextensive with the bottom wall of the body. A rear web portion 76 of the bottom pan extends along the entire lateral extent of the bottom pan and adjacent the lower portion of the back wall 40 of the body, except for interruptions formed by rearwardly open grooves 78 that receive the lower ends of the tubes 60 in nested relation and wheel wells 80 adjacent each end. A side flange 82 at each end of the bottom pan 70 joins the bottom web portion 72 to the rear web portion 76.

The top pan 52, the bottom pan 70 and the bezel 30 are each molded in one-piece from a durable rigid polymeric material, such as ABS or PS (poly styrene) or similar material. The towing bar-receiving tubes 60 are of metal.

The top wall 20 of the bag body is joined to the top pan 52 by a flap 90 on the inside of the top wall that extends along and is engaged by the front edge 56 of the top web portion 54 and is received under the top web portion (FIG. 4). The flap 90 is secured to the underside of the top portion 54 of the top pan by a strip 92 of hook and loop fastener (e.g., VELCRO®). In a similar manner, the bottom wall 34 of the bag body is joined to the bottom pan 70 by a flap 94 on the inside of the bottom wall that extends along and is engaged by the front edge 74 of the bottom web portion 72 and is received on the upper surface of the bottom web portion. The flap 94 is secured to the upper surface of the bottom web portion 72 of the bottom pan by a strip 96 of hook and loop fastener. The above-described fastening arrangement facilitates assembly of the bag and allows the number of screws or other fasteners used to join various components of the bag to the body to be reduced. The anchoring of the rear part of the bag body to the pans by the flaps 90 and 94 holds the back wall 40 and the rear portions of the top wall 20 and the bottom wall 34 taut over the pans. The lower ends of the tubes 60 are fastened in place in the grooves 78 in the bottom pan 70 by screws 98, but the upper ends of the tubes 60 are received in the sockets 62 of the bezel 30 without fasteners, except for the screws that attach the bezel 30 to the top pan 52; the tensioning of the back wall 40 and rear portions of the top wall 20 and the bottom wall 34 afforded by the securing flaps 90 and 94 holds the top pan/bezel sub-assembly in place on the tubes 60.

Figure 5:
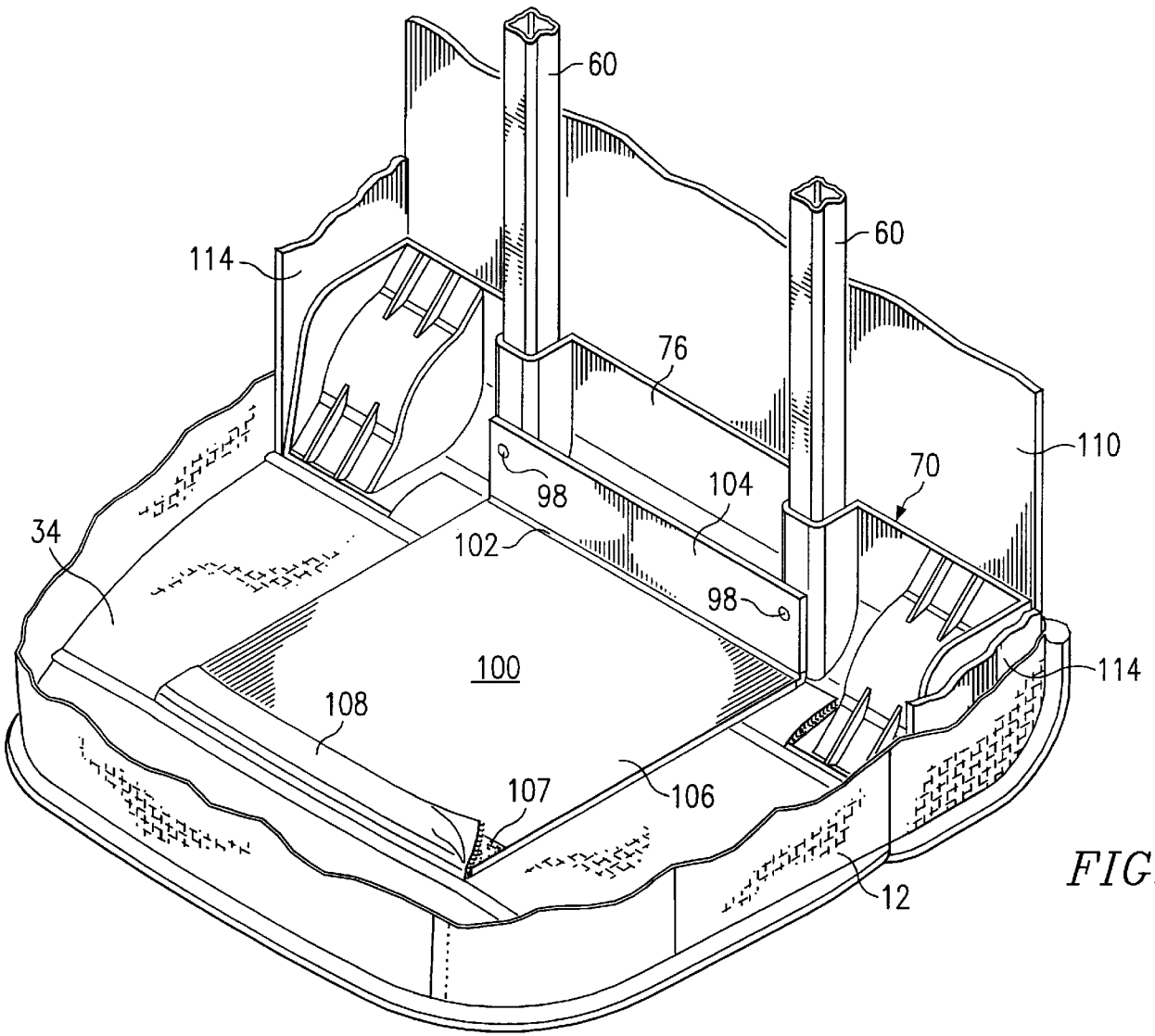
FIGS. 5 and 6 are three-quarter front perspective views, taken from a viewpoint above and to the right side of the embodiment, showing most of the upper part of the embodiment broken away, and showing the two positions of a panel that selectively holds the bottom wall of the body extended.
Figure 6:
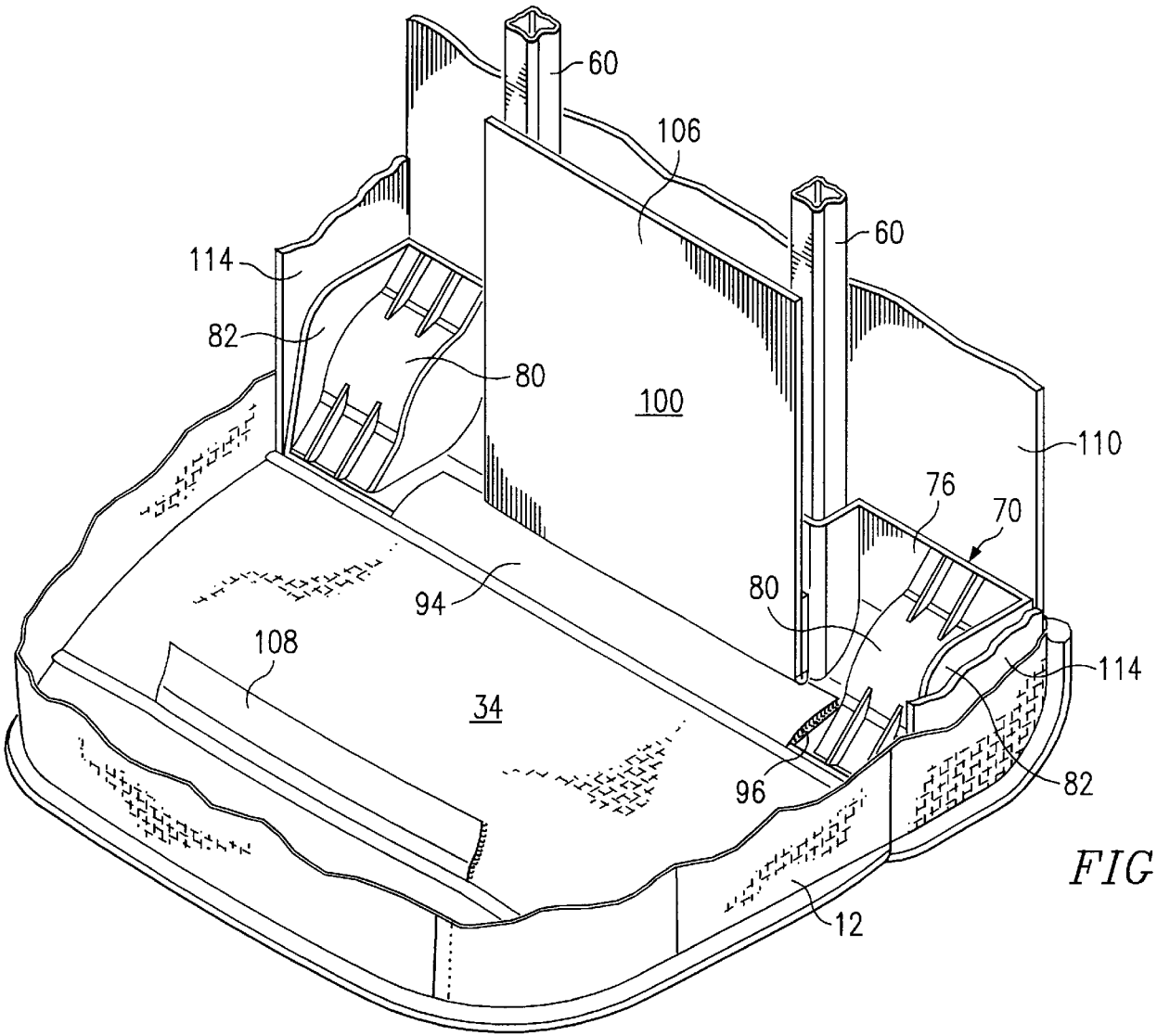

As shown in FIGS. 5 and 6, the embodiment includes a foldable panel 100 of two semi-rigid plates sandwiched in a fabric envelope so as to form a fabric hinge 102. The smaller portion 104 is fastened by the screws 98 (see FIGS. 4 and 5 the panel 100 is omitted in FIGS. 4 and 5) to the bottom pan 70. The larger portion 106 folds out so as to lie along the front portion of the bottom wall 34 of the bag body (FIG. 5) and is releasably secured in that position by a strip 107 of hook and loop fastener on the front edge of the panel 106 and on a flap 108 that is stitched to the bottom wall. With the flap in the extended position (FIG. 5), the lower front portion of the bag is held open to facilitate access to the interior of the bag. Also, the front portion of the bottom wall 34 of the body is stabilized relative to the back wall so that the bag can stand upright on the wheels 32 and the feet 36.

The embodiment includes a back stiffener panel 110 (FIGS. 4 and 5) that is coextensive with the major portion of the back wall 40 laterally and vertically and is secured in place by the screws 112 (FIG. 2) to the skid rails 42. A side stiffener panel 114, the upper and lower ends of which are loosely retained in pockets in the side walls outwardly of the side flange of the pans (FIG. 5), extend along the rear portion of each side wall 12. The panels 114 have a depth approximately equal to the depth of the pans 52 and 70. A stiffener panel 116 is incorporated in the front portion of the top wall 20 (see dotted lines in FIG. 7), the rear edge being spaced apart from the front edge 56 of the top web portion 54 of the top pan 52 to leave a fold line for the top wall.

Figure 7:
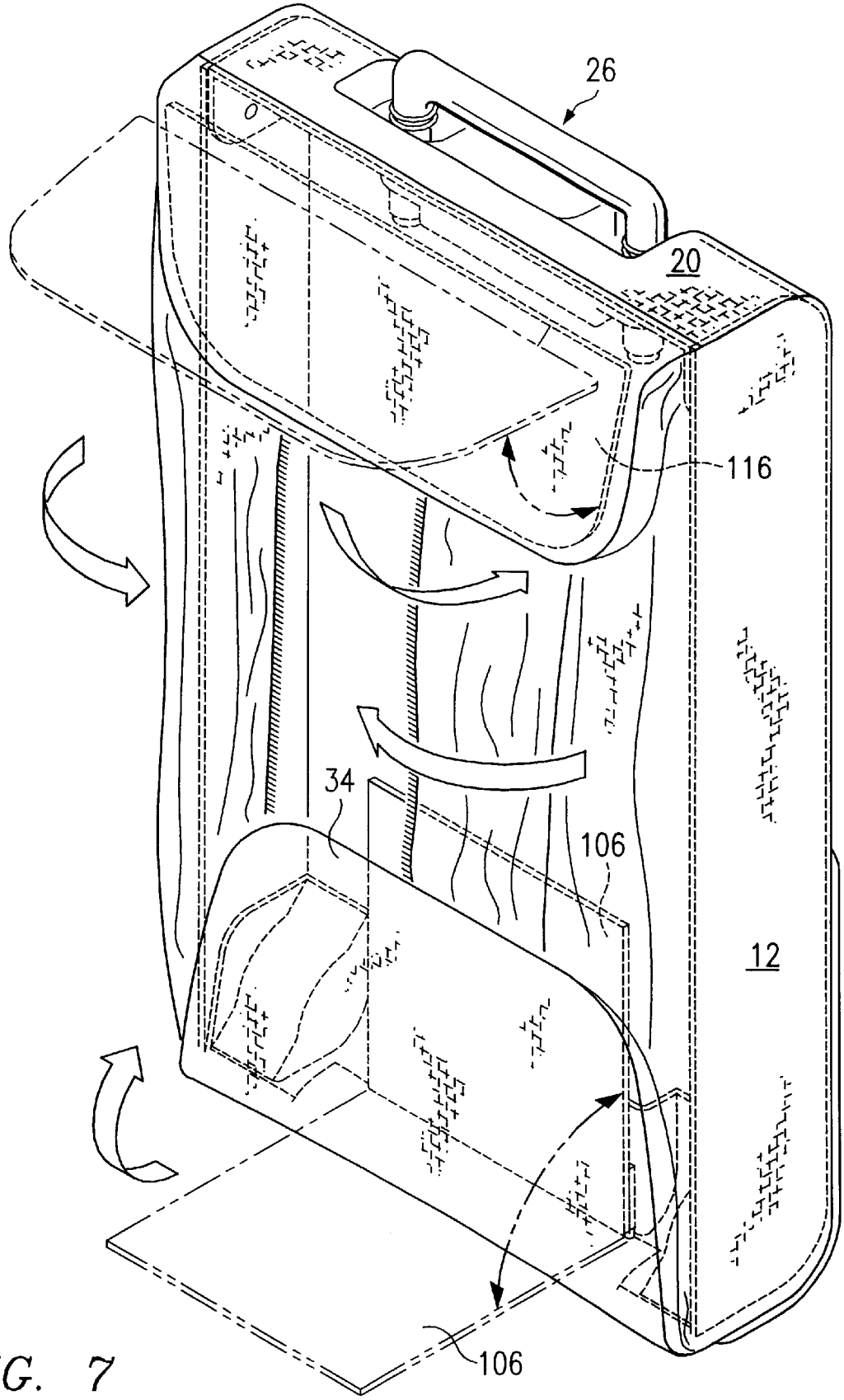
FIG. 7 is a three-quarter front perspective view, taken from a viewpoint above and to the right side of the embodiment and showing the embodiment collapsed.

The sizes, shapes and locations of the pans and the stiffener panels of the embodiment are such that the side walls 12, the top wall 20 and the bottom wall 34 of the bag are foldable along fold lines approximately coextensive with a plane defined by the front edge 56 of the top pan and the front edge 74 of the bottom pan, as shown in FIG. 7. The panel 100 is, of course, released and folded up against the tubes 60 (FIG. 6). Thus, the entire front portion of the bag body can be collapsed into a space defined depthwise by the rear wall 40 and the aforementioned plane. When collapsed, the bag occupies a little less than one-half of the volume it occupies when it is filled.

A luggage item embodying the present invention may, of course, incorporate various features that are well-known per se, such as a lining overlying the frame and back wall stiffener, side wall linings, and various pockets, such as pockets or envelopes along the top and bottom walls.

The embodiment described above and shown in the drawings is merely exemplary. Light-weight, collapsible luggage items with a frame and stiffener panel system similar to that of the embodiment can be made in other styles, such as a "suitcase" style having a flat front wall zippered along three sides close to or along the front edges of the top, bottom and one side wall. A suitcase style may be free of stiffening panels along the front portions of the top, bottom and both side walls forwardly of fold lines substantially coextensive with a plane defined by the front edges of the upper and lower pans. The front wall may have a substantially rigid wire frame along its entire perimeter to shape the front of the bag when the front wall is zippered closed.

What is claimed is:

1. An article of luggage, comprising a frame having a top pan, a bottom pan, and a pair of spaced-apart parallel towing bar-receiving tubes joining the top pan to the bottom pan in spaced-apart relation, and a body of flexible material fitted to the frame and having a top wall, a bottom wall, side walls, a front wall and a back wall, the walls being interconnected to form an enclosure to receive articles, fold lines being positioned in an intermediate portion of the top wall, the bottom wall and the side walls; and the top pan and the bottom pan having front edges spaced apart from the front wall of the body and front portions of the top wall, bottom wall and the side walls are foldable toward the back wall to enable the front wall to be collapsed and folded toward the back wall to substantially reduce the volume of the enclosure formed by the body.

2. The article of luggage according to claim 1, and further comprising a side stiffener panel substantially coextensive with a rear portion of each of the side walls of the body rearwardly of the fold line.

3. The article of luggage according to claim 1, and further comprising a foldable stiffening panel joined to the frame for pivotal movement between a folded-up position and a position in which a front edge of the foldable stiffening panel is detachably secured to a front portion of the bottom wall of the body to hold the bottom wall of the body extended.

4. The article of luggage according to claim 1, wherein each of the bar-receiving tubes is secured by a fastener to the bottom pan and is joined to the top pan by reception in sockets without any fasteners, except for screws that attach a bezel to the top pan, and is held in the socket by tension in the body.

5. The article of luggage according to claim 1, wherein the top pan has a top web portion engaged by a rear portion of the top wall of the body and having a front edge that is spaced apart from a juncture of the top wall with the front wall of the body and is coextensive laterally with the top wall of the body, the top wall is joined to the top pan by a foldable flap on the top wall that is received under the top web portion of the top pan and is secured to the top portion of the top pan by a strip of hook and loop fastener, the bottom pan has a bottom web portion engaged by a rear portion of the bottom wall of the body and having a front edge that is spaced apart from a juncture of the bottom wall with the front wall of the body and is coextensive with the bottom wall of the body, and the bottom wall of the body is joined to the bottom pan by a foldable flap on the bottom wall that is received on top of the bottom web portion of the bottom pan and is secured to the bottom web portion of the bottom pan by a strip of hook and loop fastener.

6. The article of luggage according to claim 5, wherein each of the bar-receiving tubes is secured by a fastener to the bottom pan and is joined to the top pan by reception in a socket associated with the top pan without any fasteners, except for screws that attach a bezel to the top pan, and is held in the socket by tension in the body.

7. An article of luggage, comprising a frame having a top pan, a bottom pan, and a pair of spaced-apart parallel towing bar-receiving tubes joining the top pan to the bottom pan in spaced-apart relation, the top pan being generally L-shaped in side elevation and having a top web portion and a back web portion and an end flange portion joining the lateral ends of the top web portion and the back web portion and the bottom pan being generally L-shaped in side elevation and having a bottom web portion and a back web portion and end flange portions joining the lateral ends of the top web portion and back web portion, and a body of flexible material fitted to the frame and having a top wall, a bottom wall, side walls, a front wall and a back wall, the walls being interconnected to form an enclosure to receive articles, the top web portion of the top pan and the bottom web portion of the bottom pan having front edges spaced apart from the front wall of the body and fold lines being positioned in an intermediate portion of the top wall, the bottom wall and the side walls, wherein front portions of the top wall, bottom wall and the side walls are foldable toward the back wall to enable the front wall to be collapsed and folded toward the back wall to substantially reduce the volume of the enclosure formed by the body.

8. The article of luggage according to claim 7, wherein the top wall of the body is joined to the top pan by a foldable flap on the top wall that is received under the top web portion of the top pan and is secured to the top web portion by a strip of hook and loop fastener and the bottom wall of the body is joined to the bottom pan by a foldable flap on the bottom wall that is received on top of the bottom web portion of the bottom pan and is secured to the bottom web portion by a strip of hook and loop fastener.

9. The article of luggage according to claim 7, wherein each of the bar-receiving tubes is secured by a fastener to the bottom pan and is joined to the top pan by reception in a socket associated with the top pan without any fasteners, except for screws that attach a bezel to the top pan, and is held in the socket by tension in the body.

10. An article of luggage, comprising a frame having a top pan, a bottom pan, and a pair of spaced-apart parallel towing bar-receiving tubes joining the top pan to the bottom pan in spaced-apart relation, and a body of flexible material fitted to the frame and having a top wall, a bottom wall, side walls, a front wall and a back wall, the walls being interconnected to form an enclosure to receive articles, fold lines being positioned in an intermediate portion of the top wall, bottom wall and the side walls; and the top pan and the bottom pan having front edges spaced apart from the front wall of the body, each of the top wall, bottom wall and side walls having a single fold line approximately coextensive with a plane defined by the front edge of the top pan and the front edge of the bottom pan, and wherein front portions of the top wall, bottom wall and the side walls are foldable toward the back wall to enable the front wall to be collapsed and folded toward the back wall to substantially reduce the volume of the enclosure formed by the body.

11. The article of luggage according to claim 10, wherein the top pan has a top web portion engaged by a rear portion of the top wall of the body and having a front edge that is spaced apart from a juncture of the top wall with the front wall of the body and is coextensive laterally with the top wall of the body.

12. The article of luggage according to claim 11, wherein the top wall is joined to the top pan by a flap on the top wall that is received under the top web portion of the top pan and is secured to the top web portion of the top pan by a releasable fastener.

13. The article of luggage according to claim 10, wherein the bottom pan has a bottom web portion engaged by a rear portion of the bottom wall of the body and having a front edge that is spaced apart from a juncture of the bottom wall with the front wall of the body and is coextensive with the bottom wall of the body.

14. The article of luggage according to claim 13, wherein the bottom wall of the body is joined to the bottom pan by a flap on the bottom wall that is received on top of the bottom web portion of the bottom pan and is secured to the bottom web portion of the bottom pan by a releasable fastener.

15. The article of luggage according to claim 13, wherein the bottom wall of the body is joined to the bottom pan by a flap on the bottom wall that is received on top of the bottom web portion of the bottom pan and is secured to the bottom web portion of the bottom pan by a fastener.

16. The article of luggage according to claim 10, wherein the fold lines lie substantially in a plane that is parallel to the bar-receiving tubes of the frame.

17. The article of luggage according to claim 16, wherein the plane of the fold lines is about midway between the front wall and rear wall of the body.

18. The article of luggage according claim 10, and further comprising a rear stiffener panel substantially coextensive with the rear wall of the body.

19. The article of luggage according to claim 10, wherein the top pan is generally L-shaped in side elevation and has a top web portion and a back web portion and the lateral ends of the top web portion and back web portion are joined by end flanges.

20. The article of luggage according to claim 10, wherein the bottom pan is generally L-shaped in side elevation and has a bottom web portion and a back web portion and the lateral ends of the top web portion and back web portion are joined by end flanges.

* * * * *

UNITED STATES PATENT AND TRADEMARK OFFICE

CERTIFICATE OF CORRECTION

PATENT NO. : 6,604,617 B2
DATED : August 12, 2003
INVENTOR(S) : Davis et al.

It is certified that error appears in the above-identified patent and that said Letters Patent is hereby corrected as shown below:

Column 5,
Line 62, "and front" should read -- and wherein front --

Signed and Sealed this

Thirtieth Day of December, 2003

JAMES E. ROGAN
*Director of the United States Patent and Trademark Office*